US006991229B2

(12) United States Patent
Yamakawa et al.

(10) Patent No.: US 6,991,229 B2
(45) Date of Patent: Jan. 31, 2006

(54) PAPER STACKER FOR USE WITH IMAGE FORMING APPARATUS

(75) Inventors: Mikihiro Yamakawa, Tokyo (JP); Toshio Shida, Tokyo (JP); Masahiro Kaneko, Tokyo (JP)

(73) Assignee: Konica Corporation, Tokyo (JP)

( * ) Notice: Subject to any disclaimer, the term of this patent is extended or adjusted under 35 U.S.C. 154(b) by 255 days.

(21) Appl. No.: 10/439,471

(22) Filed: May 16, 2003

(65) Prior Publication Data

US 2003/0218298 A1 Nov. 27, 2003

(30) Foreign Application Priority Data

May 23, 2002 (JP) ..... 2002-148566

(51) Int. Cl.
*B65H 31/20* (2006.01)

(52) U.S. Cl. ..... 271/223; 271/217; 271/215; 271/204

(58) Field of Classification Search ..... 271/207, 271/213, 214, 215, 217, 220, 223, 204; 414/791.2
See application file for complete search history.

(56) References Cited

U.S. PATENT DOCUMENTS 2,228,887 A * 1/1941 Peterson ..... 414/788.9
2,262,236 A * 11/1941 Huck ..... 271/215
2,300,863 A * 11/1942 Bamford ..... 271/179
2,918,852 A * 12/1959 Buccicone ..... 414/788.9
2,940,387 A * 6/1960 Pritchard ..... 101/183
2,950,108 A * 8/1960 Golding ..... 271/189
2,957,691 A * 10/1960 Williams ..... 271/215
3,378,256 A * 4/1968 Ellis et al. ..... 271/183
3,730,517 A * 5/1973 Norton ..... 271/183
3,796,427 A * 3/1974 Reutter et al. ..... 271/189
3,831,932 A * 8/1974 Conrad ..... 271/182
3,860,127 A * 1/1975 Fassman ..... 414/791.2
3,933,352 A * 1/1976 Sinn ..... 271/189
3,989,239 A * 11/1976 Scriven et al. ..... 271/204
4,083,556 A * 4/1978 Schilling et al. ..... 271/204
4,133,523 A * 1/1979 Berthelot ..... 271/182
4,396,334 A * 8/1983 Byrt ..... 414/791.2

(Continued)

FOREIGN PATENT DOCUMENTS

JP 55052839 A * 4/1980

(Continued)

*Primary Examiner*—Donald P. Walsh
*Assistant Examiner*—Matthew J. Kohner
(74) *Attorney, Agent, or Firm*—Lucas & Mercanti

(57) ABSTRACT

The present invention is to provide a paper stacker for use with an image forming apparatus of a high copying speed. The paper stacker comprises a paper conveying means for conveying a paper with an image recorded thereon to a stacking position, a top end stopper provided reciprocatively movably along a conveying path of the paper, a paper receiving plate disposed below the conveying path of the paper for receiving a paper, a rear end stopper for defining the rear end position of the paper on the paper receiving plate, and an elevating device for changing the height of the paper receiving plate, wherein the top end stopper and the rear end stopper are provided movably in the same direction in the conveyance direction per a given number of papers. The papers are stacked only by shifting the top end stopper and the rear end stopper in the conveyance direction so that the stacker configuration is extremely simplified so as to enable a high speed.

18 Claims, 2 Drawing Sheets

U.S. PATENT DOCUMENTS 4,477,218 A * 10/1984 Bean ..... 414/789.1
4,479,645 A * 10/1984 Pollich ..... 271/183
4,508,333 A * 4/1985 Byrt ..... 271/218
4,730,822 A * 3/1988 Wagner ..... 270/58.31
4,905,979 A * 3/1990 Limbach et al. ..... 271/176
5,060,929 A * 10/1991 Kohlmann ..... 271/218
5,188,353 A * 2/1993 Parks ..... 271/184
5,445,372 A * 8/1995 Blaser et al. ..... 271/309
6,056,287 A * 5/2000 Hirth et al. ..... 271/204
6,234,474 B1 * 5/2001 Horii et al. ..... 271/288
6,293,543 B1 * 9/2001 Lawrence ..... 271/213
6,505,828 B2 * 1/2003 Seitz et al. ..... 271/204
6,527,268 B2 * 3/2003 Spurk ..... 271/195
6,641,133 B2 * 11/2003 Mutschall et al. ..... 271/204
6,648,326 B2 * 11/2003 Hieb ..... 271/183
6,659,453 B2 * 12/2003 Kelm et al. ..... 271/183
6,698,573 B2 * 3/2004 Gienger ..... 198/456
6,722,650 B1 * 4/2004 Abbata et al. ..... 271/213
6,802,256 B1 * 10/2004 Koch ..... 101/416.1
6,819,906 B1 * 11/2004 Herrmann et al. ..... 399/368

FOREIGN PATENT DOCUMENTS

JP 55119656 A * 9/1980

* cited by examiner

PAPER STACKER FOR USE WITH IMAGE FORMING APPARATUS

BACKGROUND OF THE INVENTION

1. Field of the Invention

The present invention relates to a paper stacker for stacking papers with an image recorded thereon in such a state that each set of a predetermined number of papers is displaced or shifted by a given distance on one another which is designed to use with an image forming apparatus such as a copying machine, a printer, a facsimile and a composite machine thereof.

2. Description of the Prior Arts

There is an image forming apparatus, provided with a paper stacker for stacking a predetermined number of papers each with an image recorded thereon as a set in such a manner that each set is displaced or shifted by a given distance on one another. The sets of papers are stored in a state sectioned per set so as to be supplied to a post processing stage such as stapling, folding for book-binding, or the like.

In a conventionally proposed paper stacker, conveyance of supplied papers is stopped by a shift roller, and the papers are shifted together with the shift roller in a direction orthogonal to the paper conveyance direction, that is, in the lateral direction per each paper so as to be stacked.

However, in the above-mentioned paper stacker designed to shift the papers in the lateral direction with respect to their conveyance direction, subsequent papers cannot be fed during movement for shift and therefore the conveyance of papers has to be stopped intermittently in the shifting operation. Moreover, since the shifting operation in the lateral direction should be carried out by a shift roller pair, the shifting mechanism is extremely complicated. In addition, a problem arises in that it can hardly be used for image forming apparatus with a high copying speed, because there is a problem of inertia derived from the mass of the shift rollers.

SUMMARY OF THE INVENTION

Accordingly, the present invention has been achieved in view of the above-mentioned problems, and an object thereof is to provide a paper stacker for use with an image forming apparatus, and particularly such apparatus with a high copying speed.

In order to achieve the above-mentioned object, a paper stacker of the present invention comprises a paper conveying means for conveying paper with an image recorded thereon to a stacking position; a top end stopper arranged on an extreme forward position of a conveyance path of the paper in said stacking position for defining a top end position of the paper to be stacked; a paper receiving plate arranged below the paper conveyance path in the stacking position for receiving papers thereon in a shifted state; a rear end stopper arranged on a backward position of the paper conveyance path in the stacking position for defining a rear end position of the paper to be stacked; and a lifting means for moving up and down said paper receiving plate, wherein said top end stopper and said rear end stopper are movable in association with each other in the direction of the paper conveyance or vice versa alternately for every given number of papers to be stacked.

The top end stopper and/or the rear end stopper may be provided movably in the conveyance direction according to the paper size in the conveyance direction, or either one of the top end stopper or the rear end stopper may be provided movably so as to have a paper on the paper placing base abutted on the other one.

DETAILED DESCRIPTION OF THE PREFERRED EMBODIMENT

The present invention will now be explained with reference to the accompanied drawings.

Figure 1:
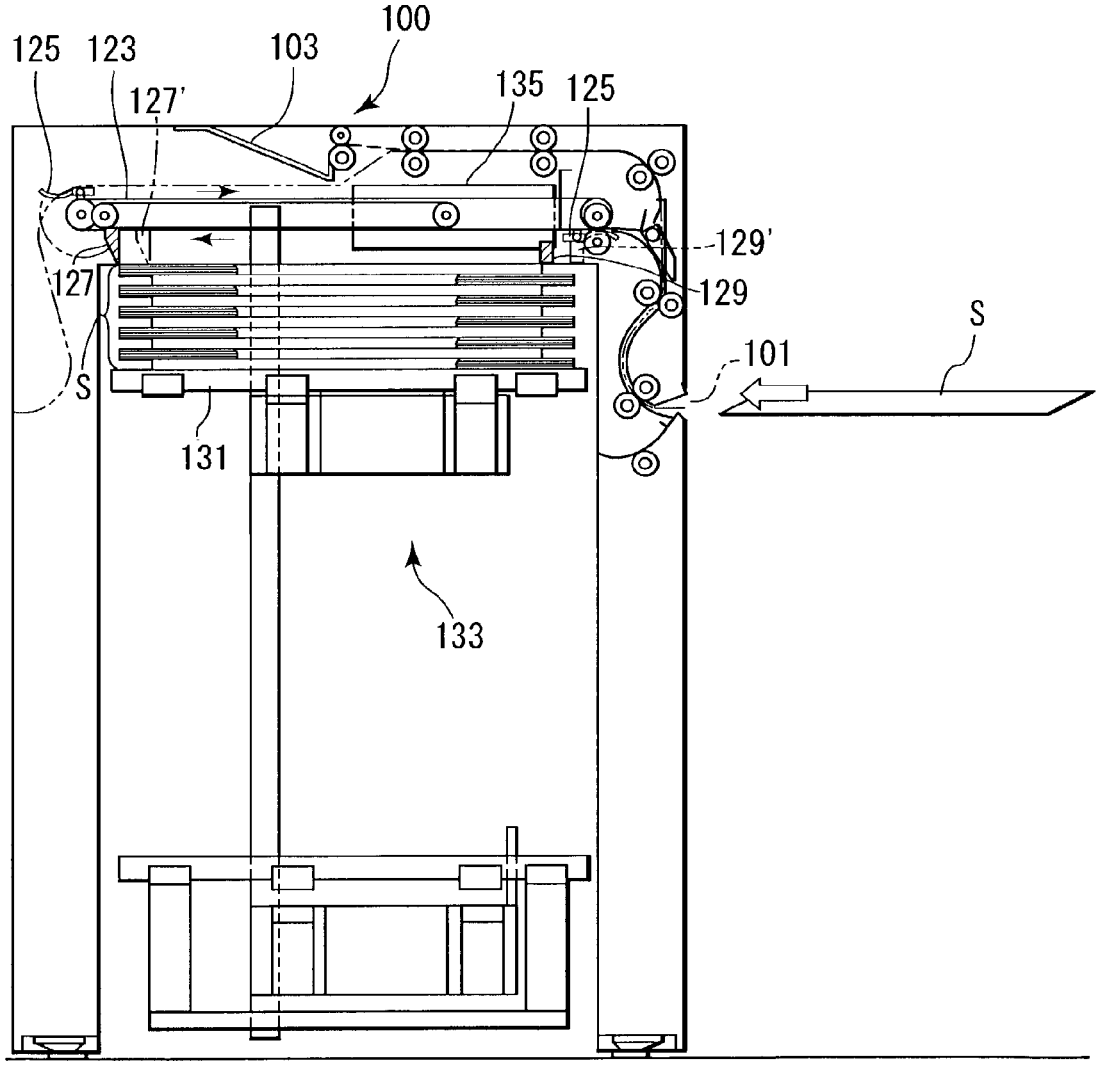
FIG. 1 shows the configuration of a paper stacker of the present invention.
Figure 2:
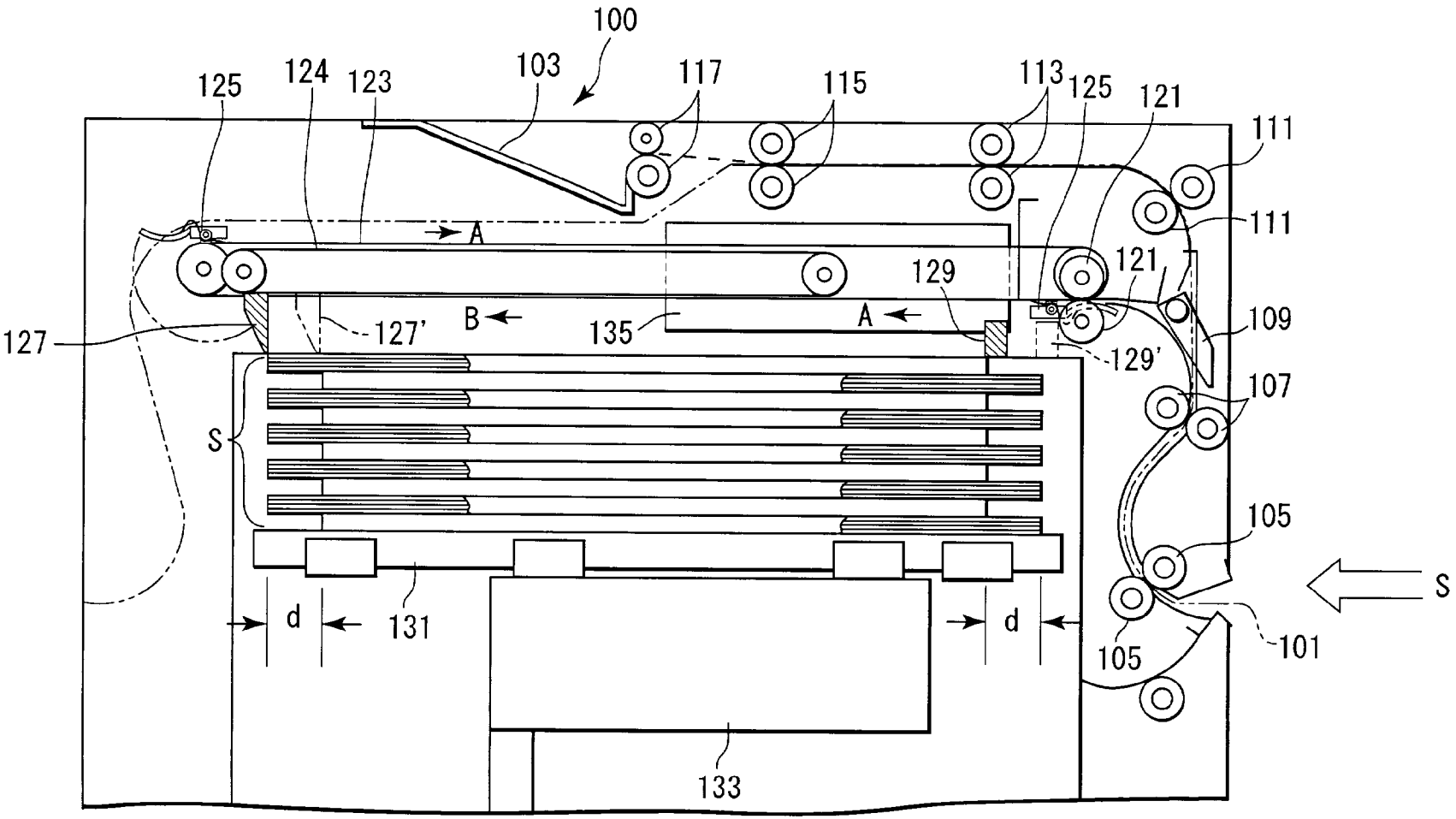
FIG. 2 shows an essential part of the paper stacker of FIG. 1 in an enlarged scale.

FIG. 1 shows the entirety of a paper stacker 100 of the present invention, and FIG. 2 shows an essential part of the inside of the paper stacker 100 in an enlarged scale. The stacker 100 shown in these drawings is designed to receive a paper S with an image formed thereon by an image forming apparatus not shown at an inlet 101 and selectively to stack the papers S as each set or to simply discharge the papers S onto a discharged paper tray 103.

The paper S introduced through the inlet 101 into the stacker 100 is conveyed by conveyance rollers 105 and 107 and reaches to a conveyance path changeover means 109. The paper S is discharged directly onto the discharged paper tray 103 or stacked in the stacker 100 by means of the conveyance path changeover means 109.

In case it is selected that the paper S is discharged directly onto the discharged paper tray 103, the conveyance path changeover means 109 is actuated to close the conveyance path toward an inlet roller 121. As a result, the paper S is conveyed by conveyance rollers 111, 113, 115 and 117 and discharged onto the discharged paper tray 103 where the papers S are stacked on one another.

In contrast, in case it is selected that the paper S is stacked in the stacker 100, the conveyance path changeover means 109 is actuated to close the conveyance path toward the conveyance roller 111 as shown in FIG. 2. As a result, the paper S passes the inlet roller 121 to be introduced into the stacker 100 and reaches the end part of circulating means 123 composed of a belt which is rotatable in a direction shown by an arrow A. The circulating means 123 is provided on its opposite positions with a pair of paper gripping means 125 which are separate equidistant from each other. When the paper S reaches the end of the circulating means 123, the paper S is gripped by the paper gripping means 125 by its top end and conveyed by the circulating means 123 leftward as shown by an arrow A in FIG. 2. The paper gripping means 125 comprises a grasping member made of hard rubber which is partly pressed with a weak force against 123 by a wire spring.

On both lateral sides of the circulating means 123 are provided a set of reciprocating means 124 composed of a belt which is moved reciprocatively in a paper conveying direction by a driving mechanism such as servo motor and a pulley. A top end stopper 127 as hatched in FIG. 2 is provided at a position close to an forward extreme end (leftmost end in the drawing) on each reciprocating means 124. The driving mechanism is controlled by a controller including a computer installed in the image forming apparatus to move the reciprocating means 124 in a direction indicated by an arrow B or vice versa so that the top end stopper 127 is moved to desired position. The position of the top end stopper 127 is determined in terms of a size in the feeding or conveyance direction of the paper S on use, and the size of the paper S in its conveyance direction is determined by the size of paper S and whether it is to be conveyed with its longer edge facing front or with its shorter edge facing front. Specifically, the size of the paper in its conveyance direction is determined in terms of selection of the tray or the like at the time of forming an image by the image forming apparatus. Upon determination of the paper size and the conveyance direction thereof, the position of the top end stopper 127 is determined as well. Two or more top end stoppers 127 may be provided widthwise of the paper S, because they are small and light in comparison with the conventional shift roller unit, and therefore force needed for movement of the top end stoppers is small and the inertial is smaller, and thus it hardly arises a problem.

When the rear end of the paper S passes the nip position of the inlet roller 121, the rear end of the paper S is released so that the paper S may drop onto a paper receiving plate 131 which is arranged under the travelling path of the paper gripping means 125. This position is called a stacking position.

The top end of the paper S proceeds together with the paper gripping means 125, and when the top end of the paper S gripped by the paper gripping means 125, or the paper gripping means 125 itself collides against the top end stopper 127 in the stacking position, the grip of the paper gripping means 125 is released so that the top end of the paper S drops onto the paper receiving plate 131.

The paper receiving plate 131 which is arranged below the paper conveyance path in the stacking position is adapted to be elevated or lowered by an elevating device 133. As the paper S is stacked on the paper receiving plate 131 successively, the uppermost surface of the papers S on the paper receiving plate 131 is raised gradually. Therefore, the paper receiving plate 131 is lowered gradually by the elevating device 133 by the thickness of the stacked papers S. More particularly a sensor (not shown) is provided to detect the height of the uppermost paper S on the paper receiving plate 131 so as to control the elevating device 133 such that a constant level of the stacked papers S is kept. However, in case it is difficult to control the height of the paper S per one sheet strictly due to the sensitivity of the sensor or the elevation accuracy of the elevating device 133, the height may be adjusted per several sheets of paper.

A rear end stopper 129 for determining the rear end position of the paper S is provided close to the rear end (close to the rightmost end of the conveyance path in FIG. 2). The rear end stopper 129 is mounted on the frame or the like of the stacker 100, and is driven to take two positions along the conveyance direction, one of which is shown by a solid line but the other 129' of which is shown by a chain line is FIG. 2. A driving mechanism for the rear end stopper 129 may comprise a servo motor and a pulley, a belt or the like, and can drive the servo motor to move the rear end stopper 129 to desired two positions. The rear end stopper 129 may be constituted by rod members that are actuated by a solenoid to raise at the position shown by the solid line or at the position shown by the chain line in FIG. 2. A distance between these two positions that the rear end stopper 129 takes is equal to a shift distanced of the sets of papers stacked on the paper receiving plate 131.

It is to be noted a distance between the top end stopper 127 and the rear end stopper 129 is selected to be larger by a given distance (for example 10 mm) than the actual length of the paper to be stacked in its conveyance direction for the below mentioned.

The elevating device 133 actuates the paper receiving plate 131 to lower slightly and gradually so that the paper S can fall onto the paper receiving plate 131 between the top end stopper 127 and the rear end stopper 129.

While a paper S falls onto the paper receiving plate 131, the top end stopper 127 is caused to move in the direction of the rear end stopper 129 so as to have the rear end of the paper S butt against the rear end stopper 129. At this time, the widthwise position of the paper S is confined from its both sides by paper width aligning means 135, whereby the paper S is placed in position on the paper receiving plate 131 as desired.

The size of the paper S in its conveyance direction is known in advance from the size of the paper size and its conveyance direction. Therefore, the top end stopper 127 is moved to such a position that the top end stopper 127 has a distance from the rear end stopper 129 that is equal to the size of the paper in its conveyance direction so that the top end stopper 127 can push the paper S on the paper receiving plate 131 against the rear end stopper 129.

The above-mentioned operation is repeated until a given number of the papers S for given sets of papers are stacked on the paper receiving plate 131. The given number of papers constitutes a set of recorded papers. The number of papers for one set can be known as for example, the number of documents to be counted by an automatic document feeding device provided in the image forming apparatus. Alternatively, the number of papers for one set can preliminarily be input manually in the image forming apparatus by an operator.

In the above-mentioned embodiment, the paper is stacked in place by shifting the top end stopper 127 toward the rear end stopper 129, but the rear end stopper 129 may be shifted toward the top end stopper 127 for the same purpose.

When the papers for one set are stacked at the same position on the paper receiving plate 131, both of the top end stopper 127 and the rear end stopper 129 are shifted in the same direction by the same distance in the conveyance direction of the paper S. For example, in FIG. 2, the top end stopper 127 is shifted to the position 127' shown by the chain line, and the rear end stopper 129 is shifted to the position 129' shown by the chain line. Thereafter, in the same manner as mentioned above, another set of papers S is stacked on the paper receiving plate 131. Repeating the same operation thereafter, the papers S are stacked on one another in the stacker 100 in such a state that each set of papers S is shifted in the paper conveyance direction.

In the embodiment as above described, two paper gripping means 125 are provided on the circulating means 123, but more than two paper gripping means may be provided on the circulating means 123 according to designing of the paper stacker.

As heretofore explained, according to the present invention, a paper stacker comprises a paper conveying means for conveying paper with an image recorded thereon to a stacking position; a top end stopper arranged on an extreme forward position of a conveyance path of the paper in said stacking position for defining a top end position of the paper to be stacked; a paper receiving plate arranged below the paper conveyance path in the stacking position for receiving papers thereon in a shifted state; a rear end stopper arranged on a backward position of the paper conveyance path in the stacking position for defining a rear end position of the paper to be stacked; and a lifting means for moving up and down said paper receiving plate, wherein said top end stopper and said rear end stopper are movable in association with each other in the direction of the paper conveyance or vice versa alternately for every given number of papers to be stacked.

Therefore the papers each with an image recorded thereon can be stacked only by shifting the top end stopper and the rear end stopper in the conveyance direction so that the stacker configuration can be extremely simplified and the paper stacker can be applied to an image forming apparatus of a high speed.

Moreover, the surface for conveying the papers and the surface for allotting the papers on the stacker are different in the paper stacker according to the invention and therefore the paper conveyance need not be stopped during the paper allocation. This is advantageous for achieving a high speed stacking.

Since either one of the top end stopper or the rear end stopper is provided movably so as to have a paper on the paper placing plate abutted on the other one, the papers to be stacked can be positioned accurately as required.

What is claimed is:

1. A paper stacker for use with an image forming apparatus comprising:

paper conveying means for conveying paper with an image recorded thereon in a paper conveyance direction to a stacking position;

a top end stopper arranged on an extreme forward position of a conveyance path of the paper in said stacking position for defining a top end position of the paper to be stacked;

a paper receiving plate arranged below the paper conveyance path in the stacking position for receiving papers thereon in a state where the papers are alternatively shifted in a direction parallel to the paper conveyance direction;

a rear end stopper arranged on a backward position of the paper conveyance path in the stacking position for defining a rear end position of the paper to be stacked; and lifting means for moving up and down said paper receiving plate, wherein said top end stopper and said rear end stopper are movable in association with each other in the same direction, either in the paper conveyance direction or in a direction opposite the paper conveyance direction to create shifted stacks of paper alternating in a direction parallel to the paper conveyance direction.

2. The paper stacker according to claim 1, wherein said paper conveying means comprises a circulating belt.

3. The paper stacker according to claim 1, wherein paper gripping means for gripping a front end of the paper is mounted on said paper conveying means.

4. The paper stacker according to claim 2, wherein a pair of paper gripping means are mounted on opposite positions of said circulating belt.

5. The paper stacker according to claim 1, wherein said top end stopper is mounted on reciprocating means capable of reciptrocatively movable in the paper conveyance direction.

6. The paper stacker according to claim 5, wherein said reciprocating means comprises a belt.

7. The paper stacker according to claim 1, wherein at least one of said top end stopper and said rear end stopper is movable in association with a size of the paper in the paper conveyance direction.

8. The paper stacker according to claim 1, wherein one of said top end stopper and said rear end stopper is movable in the paper conveyance direction to cause the paper to collide against the other of said stoppers in the end thereof while the paper falls onto said paper receiving plate in the stacking position.

9. A paper stacker comprising paper gripping means for gripping the top end of a paper after image formation and for conveying the paper in a paper conveyance direction; circulating means for supporting and circulating the paper gripping means; a top end stopper provided reciprocatively movably on the circulation path of the paper gripping means for determining the top end position of the paper; a paper placing plate provided below the circulation path of the paper gripping means for receiving a paper separated by the top end stopper and dropped from the paper gripping means; a rear end stopper for determining the rear end position of the paper on the paper placing plate; and an elevating device for changing the relative height of the paper placing plate and the circulating means, wherein the top end stopper and the rear end stopper are provided movably in the same direction in the paper conveyance direction to create shifted stacks of paper in a direction parallel to the paper conveyance direction.

10. A paper stacker for use with an image forming apparatus comprising:

a paper conveyor, which conveys paper with an image recorded thereon to a stacking position;

a top end stopper arranged on an extreme forward position of a conveyance path of the paper in the stacking position for defining a top end position of the paper to be stacked;

a paper receiving plate arranged below the paper conveyance path in the stacking position for receiving papers thereon in a state where the papers are alternatively shifted in a direction parallel to the paper conveyance; and a rear end stopper arranged on a backward position of the paper conveyance path in the stacking position for defining a rear end position of the paper to be stacked, wherein the top end stopper and the rear end stopper are movable in association with each other in the same direction, either in the direction of the paper conveyance or in a direction opposite to the paper conveyance, to create shifted stacks of paper alternating in a direction parallel to the paper conveyance.

11. The paper stacker of claim 10, wherein the paper conveyor comprises a circulating belt.

12. The paper stacker of claim 10, wherein a paper gripper, which grips a front end of the paper is mounted on the paper conveyor.

13. The paper stacker of claim 11, wherein a pair of paper gripper are mounted on opposite positions of the circulating belt.

14. The paper stacker of claim 10, wherein the top end stopper is mounted on a reciprocating member capable of reciprocatively movable in the paper conveyance direction.

15. The paper stacker of claim 14, wherein the reciprocating member comprises a belt.

16. The paper stacker of claim 10, wherein at least one of the top end stopper and the rear end stopper is movable in association with a size of the paper in the direction of conveyance thereof.

17. The paper stacker of claim 10, wherein one of the top end stopper and the rear end stopper is movable in the paper conveyance direction to cause the paper to collide against the other of the stoppers in the end thereof while the paper falls onto the paper receiving plate in the stacking position.

18. A paper stacker comprising;

a paper gripper, which grips the top end of a paper after image formation and conveys the paper in a paper conveyance direction;

a circulating mechanism, which supports and circulates the paper gripper;

a top end stopper provided reciprocatively movably on a circulation path of the paper gripper for determining the top end position of the paper;

a paper placing plate provided below the circulation path of the paper gripper for receiving a paper separated by the top end stopper and dropped from the paper gripper, and a rear end stopper for determining the rear end position of the paper on the paper placing plate, wherein the top end stopper and the rear end stopper are provided movably in the same direction as the paper conveyance direction to create shifted stacks of paper in a direction parallel to the paper conveyance direction.

* * * * *